US008188369B2

(12) United States Patent
Cheng

(10) Patent No.: US 8,188,369 B2
(45) Date of Patent: May 29, 2012

(54) FLEXIBLE FLAT CABLE ASSEMBLY WITH IMPROVED GROUNDING STRUCTURE

(75) Inventor: Yung-Chang Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 469 days.

(21) Appl. No.: 12/386,391

(22) Filed: Apr. 16, 2009

(65) Prior Publication Data

US 2009/0260850 A1 Oct. 22, 2009

(30) Foreign Application Priority Data

Apr. 16, 2008 (CN) ..... 2008 2 0300570 U

(51) Int. Cl.
*H01B 7/08* (2006.01)

(52) U.S. Cl. ..... 174/117 F; 439/607.36

(58) Field of Classification Search ..... 174/117 F, 174/117 FF; 439/607.36, 495
See application file for complete search history.

(56) References Cited

U.S. PATENT DOCUMENTS 4,287,385 A * 9/1981 Dombrowsky ..... 174/36
5,658,164 A * 8/1997 Parker ..... 439/495
6,932,648 B1 * 8/2005 Chiu et al. ..... 439/607.36

* cited by examiner

*Primary Examiner* — Chau Nguyen
(74) *Attorney, Agent, or Firm* — Wei Te Chung; Andrew C. Cheng; Ming Chieh Chang

(57) ABSTRACT

A cable connector assembly includes a housing, a flexible substrate, at least one matching stratum attached on the flexible substrate for regulating the impedance of flexible substrate and a shell. The housing includes a receiving space. The flexible substrate is received in the receiving space of the housing and includes a plurality of golden fingers exposed out the housing. The shell covers the flexible substrate without the golden fingers, the matching stratum and the housing and includes a connecting element electrically connected to the matching stratum.

12 Claims, 4 Drawing Sheets

FLEXIBLE FLAT CABLE ASSEMBLY WITH IMPROVED GROUNDING STRUCTURE

BACKGROUND OF THE INVENTION

1. Field of the Invention

The present invention relates generally to a cable assembly, and more particularly to a flexible flat cable assembly with improved grounding structure.

2. Description of the Prior Art

A Flexible Flat Cable (FFC) cable assembly is a typical cable assembly used to transmit a variety of signals, such as Low-Voltage Differential Signaling (LVDS). However, the impedance of the FFC is mostly 130 ohm which does not meet LVDS transmission requirements.

Hence, in this art, a flexible flat cable assembly to overcome the above-mentioned disadvantages of the prior art should be provided.

BRIEF SUMMARY OF THE INVENTION

A primary object, therefore, of the present invention is to provide a flexible flat cable assembly with improved grounding structure.

In order to implement the above object, the cable assembly made in accordance with the present invention comprises a housing, a flexible flat cable, at least one matching stratum attached on the flexible flat cable for regulating the impedance of flexible flat cable and a shell. The housing comprises a receiving space. The flexible flat cable is received in the receiving space of the housing and comprises a plurality of golden fingers exposed out the housing. The shell covers the flexible flat cable without the golden fingers, the matching stratum and the housing and comprises a connecting element electrically connected to the matching stratum.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
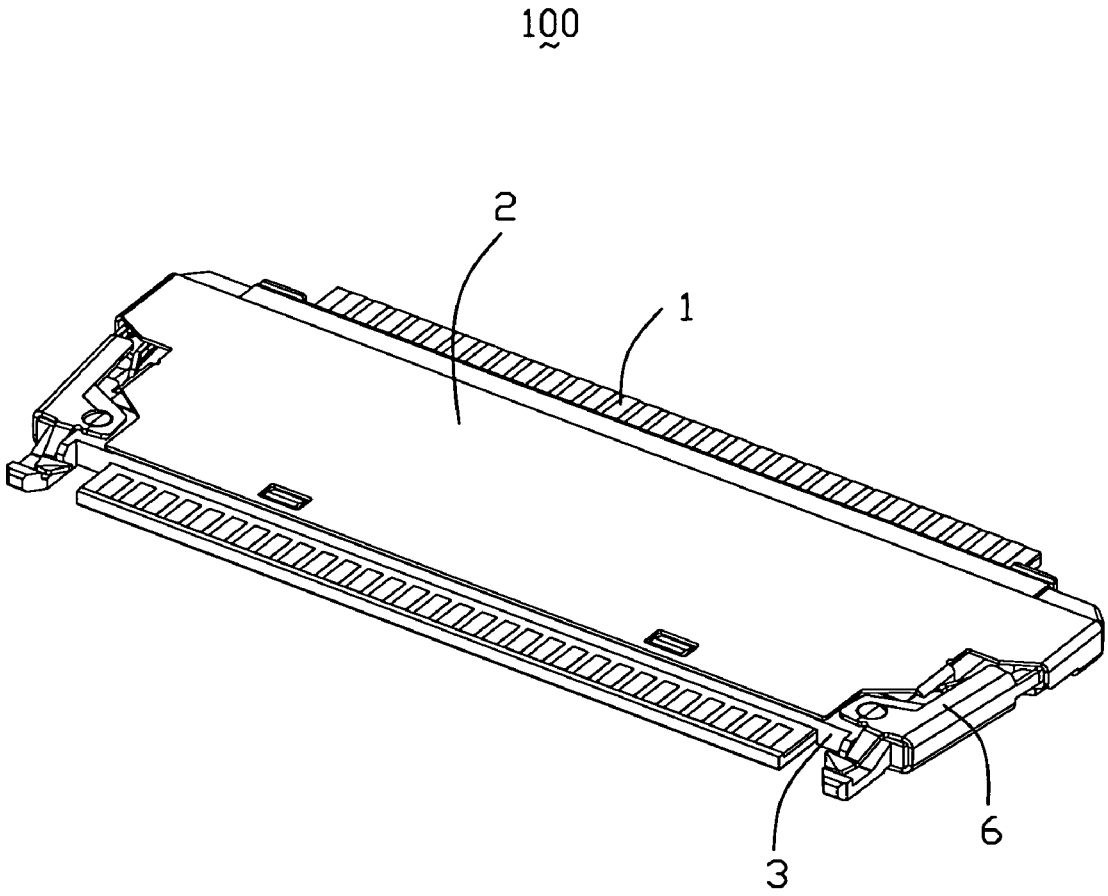
FIG. 1 is a perspective view illustrating a preferred embodiment of a cable assembly in according with the present invention.
Figure 2:
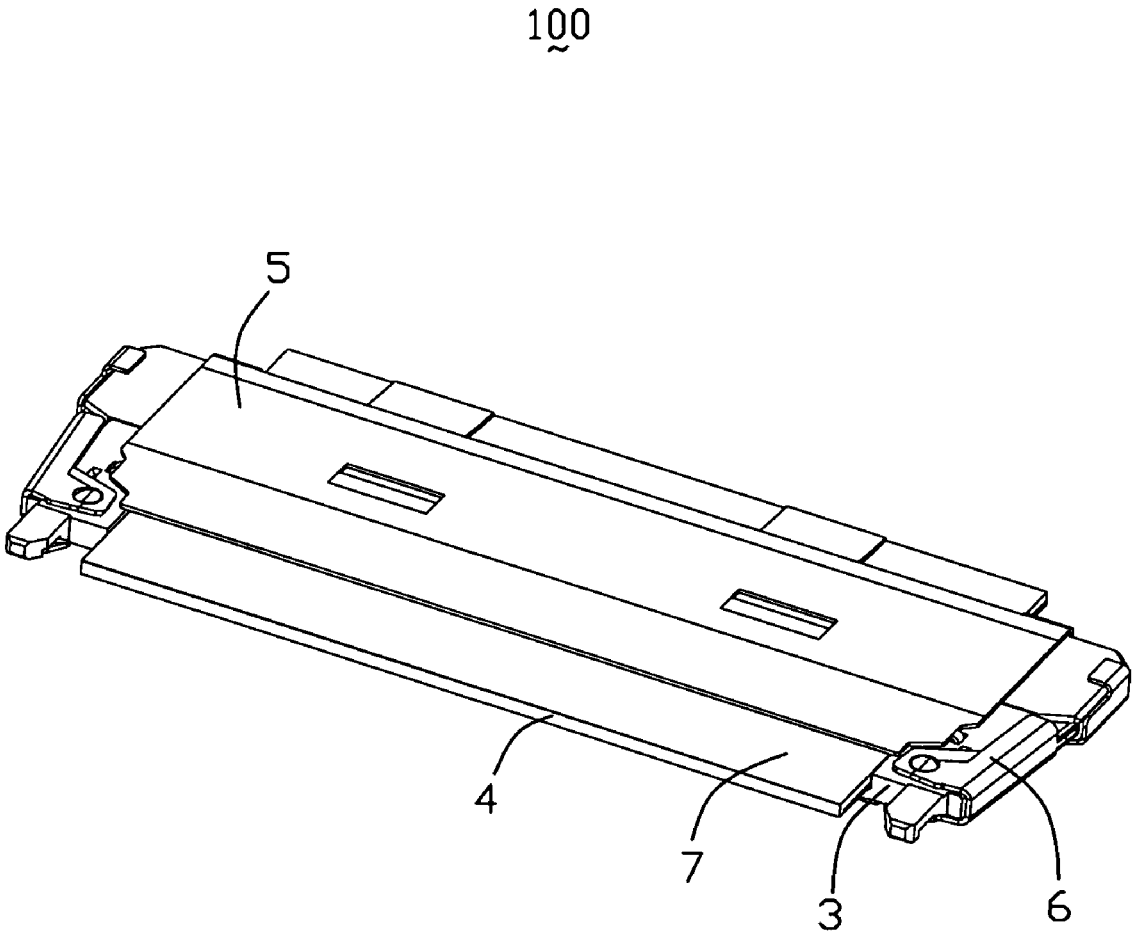
FIG. 2 is a perspective view similar to FIG. 1, but viewed from another angle.
Figure 3:
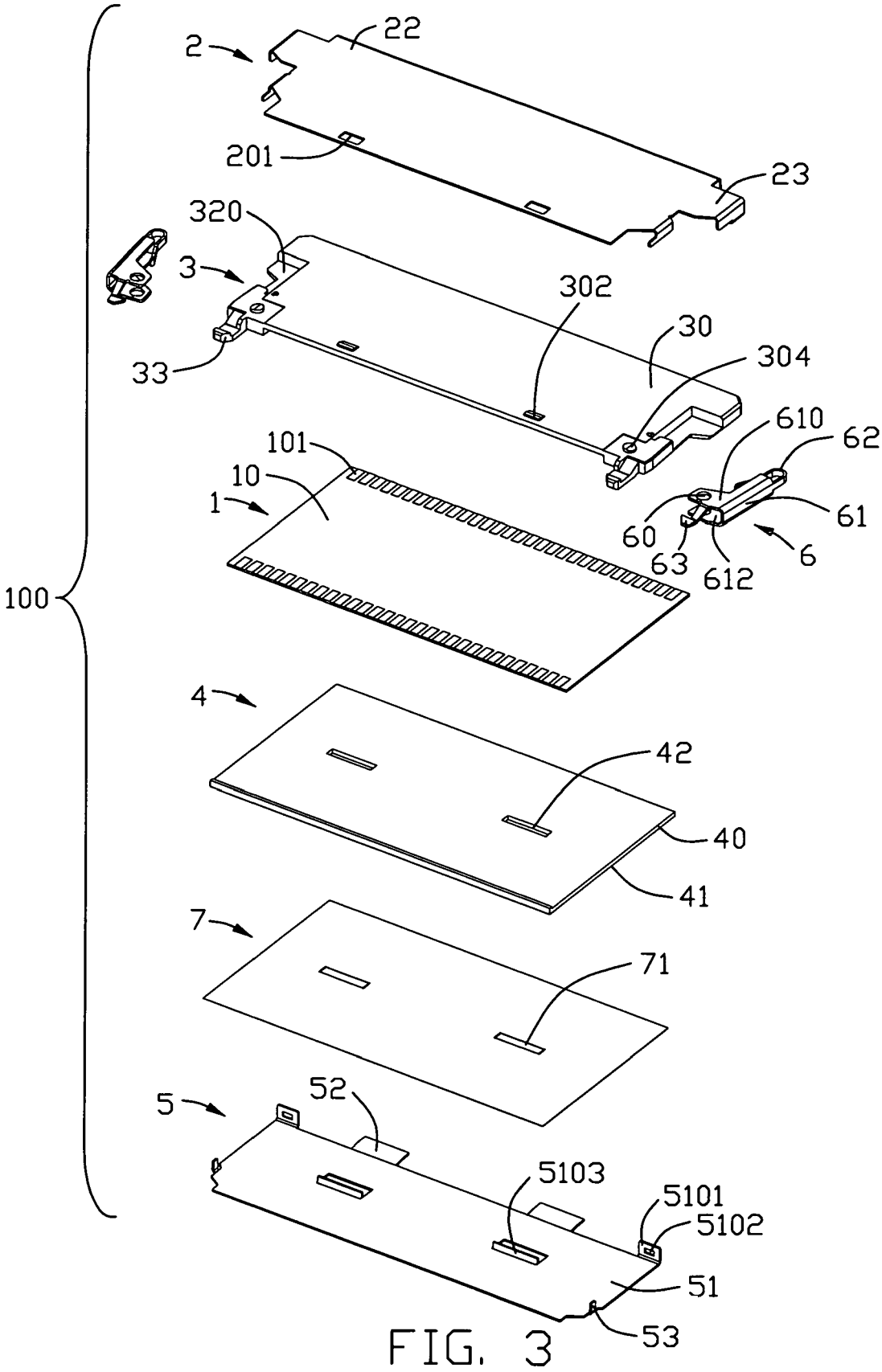
FIG. 3 is a exploded, perspective view of FIG. 1.
Figure 4:
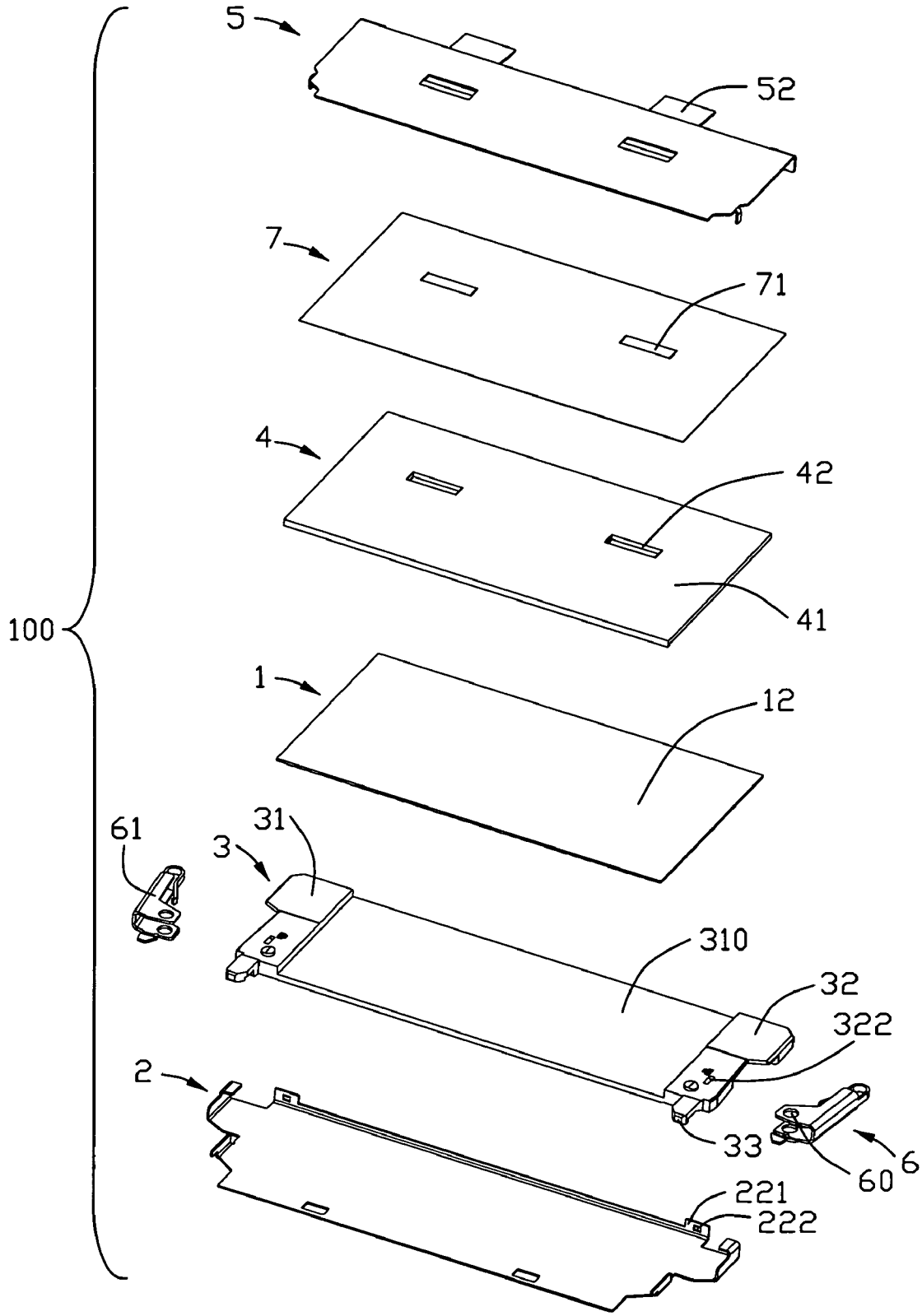
FIG. 4 is a view similar to FIG. 3, but viewed from another angle.

Reference to FIGS. 1 to 4, a cable assembly 100 in according with a preferred embodiment of the present invention is shown. The cable assembly 100 comprises a dielectric housing 3, a flexible flat cable (FFC) 1 received in the housing 3, an upper first shell 2 attached on the upper surface of the housing 3, a lower second shell 5 attached on the lower surface of the housing 3, a dielectric stratum 4 attached on the FFC 1, a pair of locking elements 6 attached on the two sides of the housing 3 and an electric stratum 7 located between the dielectric stratum 4 and the second shell 5.

The FFC 1 has an upper first surface 10 and a lower second surface 12 opposite to the first surface 10. A plurality of golden fingers 101 is formed on the first surface 10.

The housing 3 has an upper first surface 30 and a lower second surface 31. The housing 3 comprises a receiving space 310 extending upwardly from the second surface 31 thereof, a pair of retaining stages 32 formed on the two side of the receiving space 310, a pair of guiding arms 33 respectively extending forwardly from the front edge of the two retaining stages 32. A pair of locking rims 302 extends upwardly from the first surface 30 of the housing 3 and is located near the front edge of the first surface 30. Two pairs of fixing poles 304 respectively extend upwardly and downwardly from the first surface 30 and the second surface 31 on the retaining stages 32. Each retaining stage 32 has an L-shaped receiving portion 320 extending inwardly from the corresponding side edge of the first surface 30 of the housing 3, and a plurality of fastening holes 322 respectively arranged on the second surfaces 31. The FFC 1 is attached on the receiving space 310 and the golden fingers 101 are exposed out the housing 3 and arranged on the front of the housing 3. The golden fingers 101 are used to be connected to a complementary connector (not shown).

In the embodiment, the dielectric stratum 4 is made from Polyethylene Terephthalate (PET), and in other embodiment, the dielectric stratum 4 can be made from other dielectric materials. The dielectric stratum 4 has an upper surface 40 and a lower surface 41, and the upper surface 40 is attached on the second surface 12 of the FFC 1 to enhance the rigidity of the FFC 1 for the FFC securely connected to the complementary connector. The dielectric stratum 4 comprises a pair of slots 42 connecting the upper surface 40 and the lower surface 41.

The electric stratum 7 is attached on the lower surface 41 of the dielectric stratum 41 to match the impedance of the FFC. The electric stratum 7 has a pair of slots 71 corresponding to the slots 42 on the dielectric stratum 4. In the embodiment, the electric stratum 7 is made from cooper, and in the other embodiment, the electric stratum 7 can be made from other electric material.

Each the locking elements 6 is made from metal material and comprises a main body 61 and a spring piece 62 extending from the main body 61 and bend to be substantially a U shape. The main body 61 has a pair of fixing arms 610 respectively extending from the two sides of the main body 61 to form a receiving groove 612 therebetween, and a locking arm 63 extending forwardly from the upper fixing arm 610. Each fixing arm 610 has a hole 60 and all the holes 60 respectively correspond to the fixing pole 304 of the housing 3. The locking elements 6 are assembled on the two sides of the housing 3 through the fixing poles 34 of the housing 3 being respectively inserted into their corresponding holes 60 of the fixing arms 610. When the locking elements 6 are assembled on the housing 3, the locking arms 63 are respectively received in their corresponding guiding arms 33 of the housing 3.

The first and second shells 2, 5 are respectively made from metal material. The first shell 2 is attached on the first surface 30 of the housing 3 and the second shell 4 is attached on the second surface 31 of the housing 3 and covers the electric stratum 7 and the dielectric stratum 4. The first shell 2 comprises a pair of fastening arm 23 which extending from the above of the first surface 30 of the housing 3 to the below of the second surface 31 to crimp the housing 3, a pair of locking slots 201 corresponding to the two locking rims 302 of the housing and a pair of fastening piece 221 each of which has a fastening pin 222 on the middle thereof. The second shell 5 comprises a main body 51, a plurality of fastening pins 53 extending upwardly from the two sides of the main body 51, a pair of fastening piece 5101 corresponding to the fastening piece 221 of the first shell 2, a pair of fastening rims 5103 corresponding to the slots 42, 71 on the dielectric stratum 4 and the electric stratum 7, and a pair of connecting arms 52 extending backwardly from the back edge thereof. Each fastening piece 5101 has a fastening gap 5102 corresponding to the fastening pin 222 of the first shell. When the first and second shells 2, 5 are attached on the housing 3, the fastening pieces 221, 5101 of the first and second shells 2, 5 caught each other, the fastening pins 53 are inserted into the fastening holes 322 of the housing 3, the fastening arms 23 crimp the housing 3, the fastening arms 5103 are respectively inserted into the slots 42, 71 to securely fix the dielectric stratum 4 and the electric stratum 7, and the connecting arms 52 are electrically connected to the electric stratum 7. In the embodiment, each of the connecting arms 52 is made by a spring patch of which the top is attached on the electric stratum 7. And in other embodiment, the connecting arms 52 can be an electric pin and spaced apart from the electric stratum 7, and the connecting arms 52 are soldered with the electric stratum 7 to electrically connect the connecting arms 52 and the electric stratum 7.

In assembly, the electric stratum 7 is attached to the dielectric stratum 4 and the dielectric stratum 4 with the electric stratum 7 is attached to the FFC 1. The FFC 1 and the electric stratum 7 are respectively arranged on the two sides of the dielectric stratum 4. The dielectric stratum 4 and the electric stratum 7 form a mating stratum of the FFC 1 for regulating the impedance of the FFC 1. The FFC 1 with the dielectric stratum 4 and the electric stratum 7 is received in the receiving space 310 of the housing 3, and the locking elements 6 are respectively attached on the two sides of the housing 3. And then, the first shell 2 and the second shell 5 are respectively assembled on the upper surface 30 and the lower surface 31 of the housing 3. And then, the first shell 2 covers the first surface 30 of the housing 3, the second shell 5 covers the second surface 31 and the locking element 6, and the second shell 5 is electrically connected to the electric stratum 7. Thus, the FFC 1 can achieve right impedance and be directly connected to the complementary connector.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable assembly, comprising:

a housing, comprising a receiving space;

a flexible substrate, received in the receiving space of the housing and comprising a first row of golden fingers extending across a front end of the flexible substrate, and a second row of golden fingers extending across a rear end of the substrate in align with the first row of golden fingers;

at least one matching stratum attached on the flexible substrate for regulating the impedance of flexible substrate and comprising a pair of slots; and a shell, covering the flexible substrate with the golden fingers exposed out the shell, the matching stratum and the housing and comprising a connecting element electrically connected to the matching stratum and a pair of fastening rims extending inwardly therefrom and corresponding to the slots of the matching stratum; wherein said connecting element extends from the back edge of the shell and forms a top connected to the matching stratum, said matching stratum comprises a dielectric stratum attached on the flexible substrate and an electric stratum attached on the dielectric stratum, said connecting element of the shell is electrically connected to the electric stratum, the fastening rims are respectively inserted into the slots of the matching stratum.

2. The cable assembly as claimed in claim 1, further comprising a pair of locking elements, said locking elements are respectively assembled on the two sides of the housing and arranged between the housing and the shell.

3. The cable assembly as claimed in claim 2, wherein said housing comprises a pair of guiding arms and said each locking element comprises a locking arm corresponding to one of the guiding arms, each said locking arm is received in its corresponding guiding arm.

4. The cable assembly as claimed in claim 1, wherein said connecting element extends from the back edge of the shell and spaced apart from the matching stratum, said connecting element is soldered on the matching stratum.

5. The cable assembly as claimed in claim 4, wherein said matching stratum comprises a dielectric stratum attached on the flexible substrate and an electric stratum attached on the dielectric stratum, said connecting element of the shell is electrically connected to the electric stratum.

6. The cable assembly as claimed in claim 5, wherein said shell comprises a pair of fastening rims extending inwardly therefrom, said matching stratum comprises a pair of slots corresponding to the fastening rims, and the fastening rims are respectively inserted into the slots of the stratum.

7. The cable assembly as claimed in claim 6, further comprising a pair of locking elements, said locking elements are respectively assembled on the two sides of the housing and arranged between the housing and the shell.

8. A cable assembly, comprising:

a housing, comprising an upper surface and a lower surface and a receiving space;

a flexible substrate received in the receiving space, attached on the lower surface of the housing and comprising a first row of golden fingers extending across a front end of the substrate, and a second row of golden fingers extending across a rear end of the substrate in align with the first row of golden fingers;

at least one matching stratum attached on the flexible substrate for regulating the impedance of flexible substrate, and comprising a dielectric stratum attached on the flexible substrate, an electric stratum attached on the dielectric stratum, and a pair of slots;

a first shell, covering the flexible substrate with the golden fingers exposed out the first shell, the matching stratum and the lower surface of the housing, and comprising a connecting element electrically connected to the matching stratum; and a second shell, covering the upper surface of the housing and comprising a pair of fastening rims extending inwardly therefrom and corresponding to the slots, said fastening rims being respectively inserted into the slots of the stratum; wherein said connecting element is electrically connected to the electric stratum, extends from the back edge of the shell and forms a top connected to the matching stratum.

9. The cable assembly as claimed in claim 8, further comprising a pair of locking elements, said locking elements are respectively assembled on the two sides of the housing and arranged between the housing and the shell.

10. A cable connector assembly comprising:

a flexible flat cable (FFC) defining opposite first and second faces and exposing at least one row of conductive pads at a front edge region thereof for mating;

an insulative housing positioned upon the first face;

a combo matching stratum positioned upon the second face for regulating impedance of FFC;

a first shell covering the insulative housing and cooperating with said FFC to sandwich said housing therebetween; and a second shell covering the combo stratum and cooperating with said FFC to sandwich said combo stratum therebetween; wherein said matching stratum includes a dielectric stratum and an electric stratum stacked together under condition that the dielectric stratum is positioned upon the FFC and the electric stratum is positioned upon the second shell.

11. The cable connector assembly as claimed in claim 10, wherein the conductive pads are located upon the first face.

12. The cable connector assembly as claimed in claim 10, wherein a width of said matching stratum is essentially equal to that of said FFC.

* * * * *